United States Patent [19]

Pearson

[11] Patent Number: 4,787,520

[45] Date of Patent: Nov. 29, 1988

[54] ARTICLE DISPLAY

[76] Inventor: Robert C. Pearson, 7000 Bryan Dairy Rd., Bldg. B, Ste. 1, Largo, Fla. 33543

[21] Appl. No.: 928,469

[22] Filed: Nov. 7, 1986

Related U.S. Application Data

[63] Continuation-in-part of Ser. No. 791,356, Oct. 25, 1985.

[51] Int. Cl.[4] ..... A47F 7/00

[52] U.S. Cl. ..... 211/13; 211/189; 248/DIG. 2

[58] Field of Search ..... 211/13, 60.1, 189, 206, 211/191; 248/DIG. 2

[56] References Cited

U.S. PATENT DOCUMENTS 3,817,392 6/1974 Bloch ..... 248/DIG. 2 X 4,558,788 12/1985 Grothaus ..... 211/13

*Primary Examiner*—Ramon O. Ramirez

*Assistant Examiner*—Blair M. Johnson

*Attorney, Agent, or Firm*—Frijouf, Rust & Pyle

[57] ABSTRACT

An article display is described for displaying a plurality of articles comprising a base with supporting posts attached to the base. The supporting posts releasably support horizontal members which support a bridging member(s). Each horizontal member includes a grasping means for releasingly gripping the respective supporting post enabling the horizontal members to be vertically positioned along the vertical length of the respective supporting post. A bridging member interconnects the horizontal members positioned at adjacent supporting posts thereby providing a continuous display for the plurality of articles to be displayed spanning from one supporting post to an adjacent supporting post and enabling the removal the bridging member or one of the horizontal members as determined by the removal of displayed articles from the plurality of articles displayed thereon thereby maintaining the article display filled with displayed articles. A particular article display tray is also disclosed.

16 Claims, 7 Drawing Sheets

ARTICLE DISPLAY

RELATED APPLICATIONS

This application is a continuation-in-part of Ser. No. 791,356 filed Oct. 25, 1985 and which is incorporated herein in its entirety.

BACKGROUND OF THE INVENTION

1. Field of the Invention

This invention relates to an article display utilizing a plurality of trays for supporting and displaying eyeglasses and other items. More specifically it relates to horizontal supporting trays designed to display eyeglasses along a horizontal plane at an angle offering greater visual appeal to potential customers.

2. Background of the Invention

Many of the display trays used for exhibiting eyeglasses having supporting trays glued onto supporting posts. These do not offer much flexibility in arrangement of displays. Moreover the trays neither exhibit the eyeglasses at an attractive angle nor display a plurality of eyeglasses along a horizontal plane.

It is an object of this invention to provide display trays for eyeglasses and other items which trays must be easily clipped or fastened onto supporting posts and which support at least an additional tray for displaying eyeglasses or the like.

It is a further object of this invention to provide such trays which can also be moved around on or removed from the supporting posts.

It is a further object of this invention to provide such trays which will support the eyeglasses at an angle most attractive for observation by potential customers.

It is a further object of this invention to provide an article display for displaying a plurality of articles in a horizontal plane without empty display trays or voids occurring as the article, such as eyeglasses, is removed from the article display.

It is a further object of this invention to provide an article display for a plurality of articles whereby as the articles displayed thereon are removed, a display tray may be removed form the article display to thereby maintain the article display in a filled condition.

It is a further object of this invention to provide an article display where each article displaying member or display tray is for one article and where the articles can be displayed along a horizontal plane and where each empty tray can be removed from those trays having an article displayed thereon.

It is a further object of this invention to provide an article display where each article displaying member or display tray is for one article and where the articles can be displayed along a horizontal plane such that the addition of more article display members or tray(s) is possible as more articles to be displayed become available for display thereby providing additional article display members in the filled article display.

It is a further object of this invention to provide a horizontal member with a grasping means where the portion of the grasping means which grippingly engages the circumference of the supporting post has a length and grip sufficient to support the lateral weight of the bridging members and articles placed thereon.

The foregoing has outlined some of the more pertinent objects of the present invention. These objects should be construed to be merely illustrative of some of the more pertinent features and applications of the invention. Many other beneficial results can be obtained by applying the disclosed invention is a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

In accordance with the present invention a new display tray for eyeglasses and other items has been designed which is easily clipped or fastened onto a supporting post having a cylindrical cross-section of appropriate diameter so that an opening in the tray will allow the tray to slide to a partially circular opening having a diameter the same as the outside diameter of the post and providing a tight fit against the post. The tray is made of a plastic material having sufficient resiliency so that there will be sufficient bending thereof to allow entry into the said circular portion of the opening and to provide a tight fit against the post. With the tray in this position on the post, the tray has a trough extending at a 90° angle with the post, with the front or forward edge of the trough lying in a plane approximately parallel to the linear axis of the post and spaced from the closest surface of said post so that eyeglasses positioned with the bottom of the glasses against the front edge of the trough and the bridge of the glasses leaning against the said post will be tilted at a backward angle. Advantageously the said plane is spaced a distance of 0.1–0.3 inch, preferably 0.15–0.25 inch from the nearest point on the surface of the post.

The tray of this invention may be used in a various manners. With individual posts a number of trays may be clipped onto the posts in various ways and easily removed or moved to various positions. Moreover a number of posts may be used, for example, in a case or in any other manner and one or more eyeglasses displayed in the manner described above.

As stated above the tray may be of the appropriate resiliency and strength to serve the function described herein. Preferably the material is a clear transparent plastic although translucent and even colored plastics may be used. A particularly effective material is polycarbonate resin. This is available commercially under the trademark "Lexan".

In a further embodiment of the invention, the invention may be incorporated into an article display for displaying a plurality of articles comprising a base with a plurality of supporting posts secured to the base and with each supporting post extending vertically relative the base and each supporting post being spaced apart relative each other. A plurality of horizontal members is provided with each horizontal member of the plurality of horizontal members including a first portion, a second portion and an intermediate portion. Each of the first and second portions of each horizontal members defines a first and second trough, respectively, to enable the positioning of the article to be displayed thereon. Each intermediate portion of each horizontal member defines a grasping means for releasingly gripping one of the plurality of vertical supporting posts to enable each horizontal member to be vertically positioned along the vertical length of one of the plurality of supporting posts. Each first and second portion of each horizontal member is axially spaced apart to provide an opening to permit each grasping means of each horizontal member to grippingly receive one of the plurality of supporting posts therethrough. Each first and second trough of each horizontal member includes a first and second end such that each first end of each first and second trough is distally positioned relative the intermediate portion of each horizontal member. A bridging member is provided for interconnecting one of the horizontal members positioned at one of the supporting posts of the plurality of supporting posts with another horizontal member of the plurality of horizontal members positioned at an adjacent supporting post of the plurality of supporting posts. The bridging member includes a first section, a second section and a midsection. A first fastening means is provided for enabling a releasable attachment of the first section of the bridging member with one horizontal member of the plurality of horizontal members positioned along the length of one of the supporting posts. A second fastening means is provided for enabling a releasable attachment of the second section of the bridging member with another horizontal member of the plurality of horizontal members positioned along the length of the adjacent supporting post of the plurality of supporting posts. The article display of the invention thereby provides a continuous display for the plurality of articles to be displayed spanning from one of the plurality supporting posts along the bridging member and to the adjacent supporting post and enables the removal of one of the horizontal members and bridging member as determined by the removal of displayed articles from article display thereby maintaining an article display filled with display articles.

In a further embodiment of the invention the article display for displaying a plurality of articles comprises a base with a first and second supporting post attached thereto with each post extending vertically relative the base and each post being spaced apart on the base relative each other. A first and second horizontal member is provided with each first and second horizontal member including a first portion, a second portion and an intermediate portion. Each of the first and second portions of each first and second horizontal member defines a first and second trough, respectively, to enable the positioning of the article to be displayed thereon. Each intermediate portion of each first and second horizontal member defines a grasping means for releasingly gripping one of the first and second vertical supporting post to enable each of the first and second horizontal member to be vertically positioned along the vertical length of the first and second supporting post. Each first and second portion of each first and second horizontal member being axially spaced apart to provide an opening to permit each of the grasping means of each first and second horizontal member to grippingly receive one of the first and second supporting posts. Each first and second trough of each first and second horizontal member includes a first and second end such that each first end of each the first and second troughs is distally positioned relative the intermediate portion of each first and second horizontal member. A bridging member includes a first section, a second section and a midsection. A first fastening means enables an interconnecting attachment of the bridging member with the first horizontal member when the first horizontal member is positioned along the vertical length of the first supporting post by fastening the first end of the first horizontal member to the second section of the bridging member. A second fastening means enables an interconnecting attachment of the bridging member with the second horizontal member when the second horizontal member is positioned along the length of the second supporting post by fastening the first end of the second horizontal member to the first section of the bridging member. This provides a continuous display for the plurality of articles to be displayed spanning from the first supporting post to the second supporting post and enabling the removal of one of the first and second horizontal member and bridging member as determined by the removal of the displayed articles from article display thereby maintaining an article display filled with displayed articles.

In a preferred embodiment, the bridging member includes a plurality of article displaying members where each article displaying member of the plurality of article displaying members displays one of the plurality of articles thereon. Each article displaying member of the plurality of article displaying members includes a first end segment, a second end segment and a mid-segment such that the first end segment and the second end segment are provided with an interattaching means to enable one article displaying member of the plurality of article displaying members to releasably attach and interconnect to another article displaying member of the plurality of article displaying members thereby enabling the removal of one of said article display members as one of the articles displayed from the plurality of articles displayed is removed to enable the article display to remain filled with displayed articles.

In a more specific embodiment the interattaching means is a mortise and tenon joint such that the tenon positioned at one of the first and second end segments of the article displaying member is slidably and frictionally received into a mortise formed at one of the first and second end segment of another of the article displaying member to releasingly attach and interconnect the article displaying members at the resulting mortise and tenon joint.

In another embodiment of the invention the plurality of article displaying members includes a plurality of bridging display trays wherein each bridging display tray includes a first end and a second with a trough extending therebetween to enable the positioning of the article to be displayed thereon. The bridging tray also includes an intermediate section. The intermediate section of the bridging display tray includes an aperture formed therein. An elongated bar having a first and second end with the first end of the elongated bar being securably fit into the aperture formed in the bridging display tray to enable the article to be displayed to be supported in an upright manner thereby enhancing the appearance of the article displayed and presenting the article displaying in a manner permitting visual examination.

In a further embodiment of the invention the grasping means comprises a semicircle portion having two sidewalls leading from the semicircle portion thereby defining the opening formed by the axially spaced apart first and second portion of each of the horizontal members to permit the semicircle portion grippingly receive the supporting post such that the first and the second troughs of the horizontal member are positioned substantially entirely in front of the vertical supporting post.

The invention may also be incorporated into an article display comprising a base with a supporting post attached to the base extending substantially vertically relative the base. A first and a second article displaying member is provided for displaying an article thereon respectively. The first article displaying member is securely fastened to the supporting post in a substantially horizontal plane relative the supporting post. An interlinking rod having a first and second end is provided with an opening formed at each first and second end of the rod. The opening at the first end of the rod is dimensioned to frictionally receive the first article displaying member to enable the attachment of the rod to the first display tray. The opening at the second end of the rod is dimensioned to frictionally receive the second article displaying member thereby connecting the first article displaying member with the second article displaying member to enable the display of a plurality of articles where only the first article displaying member is directly fastened to the supporting post and to enable the removal of the second article displaying member as one of the articles displayed from one of the first and second display trays is removed thereby maintaining an article display filled with displayed articles.

In another embodiment of the invention the interlocking rod further includes an intermediate segment which includes a first hinge to enable movement of the first end of the rod relative the second end of the rod thereby enabling positioning of the article displaying member to permit enhanced visual examination of the article displayed. In a further embodiment of the rod further includes a second hinge positioned at one of the first and second ends of the rod to enable the second article displaying member to be positioned at any desired display angle relative the display angle of the first article displaying member thereby further enhancing the appearance of the article displayed and further presenting the article displayed at its best view for visual examination.

The invention may also be incorporated into an article display tray for use with a horizontal article displaying member or display tray secured to a supporting post comprising a bridging display tray having a first and second end with a trough extending therebetween. The bridging tray further includes an intermediate section. The intermediate section of the bridging display tray includes an aperture formed therein. An elongated bar having a first and second end is dimensioned such that the first end is fixedly received into the aperture formed in the bridging display tray to enable the article to be displayed to be supported in an upright manner thereby enhancing the appearance of the article displayed and presenting the article displayed in a manner to permit visual examination. A first and second attachment means is positioned at the first and second end of the bridging display tray, respectively, to enable the bridging display tray to be releasably secured to the horizontal tray to enable the removal of the bridging display tray as one of the articles displayed from one of the horizontal tray and the bridging display tray is removed thereby maintaining an article display filled with displayed articles.

In another embodiment of the invention the elongated bar is releasably secured into the aperture formed into the intermediate part of the bridging display tray to enable the display of articles not requiring the bar to permit visual examination such as wallets and the like.

In a preferred embodiment of the invention the first and second attachment means is a mortise and tenon joint, respectively, such that the bridging displaying tray is releasingly attached and interconnected at the mortise and tenon joint.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Simular reference characters refer to similar parts throughout the several views of the drawings.

DETAILED DESCRIPTION OF THE DRAWINGS

Figure 1:
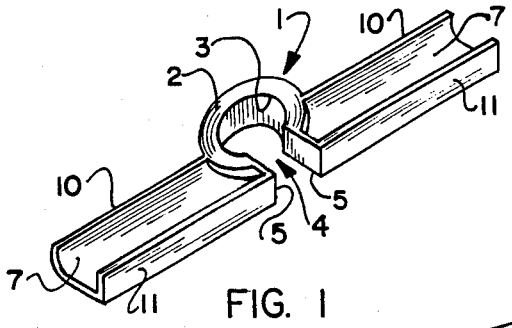
FIG. 1 is a perspective view of a preferred modification of the tray of this invention.

More specifically FIG. 1 shows the tray 1 which has post encircling portion 2 having a partial circular opening 3 whose inner diameter corresponds to the outer diameter of the post of circular cross-section on which the tray is to be clipped or mounted. The circular portion of the opening 3 leads to an entry opening 4 having substantially parallel side walls 5. The distance between the respective side walls 5 is slightly less than the diameter of circular opening 3. With the appropriate resiliency of the plastic material walls 5 may be spread further apart sufficient to allow the tray to be slid over the diameter of the post 6 (See FIG. 2) until the circular opening 3 partially encircles and is in contact with the cylindrical surface of the post 6. Walls 5 may be tapered outwardly from its junction with circular potion 3 with increasing distance beween walls 5 as the distance increases from the said junction. The walls 5 may also be tapered slightly inwardly toward each other provided the resiliency of the plastic material is sufficient to allow enough spreading apart of the walls 5 to allow passage of post 6 therebetween.

Tray 1 also has two troughs 7 whose front edges 7′ are in a plane substantially parallel to the linear axis of post 6. The front edges 7′ of troughs 7, as well as the said plane, are spaced from the closest point on the post 6.

Figure 2:
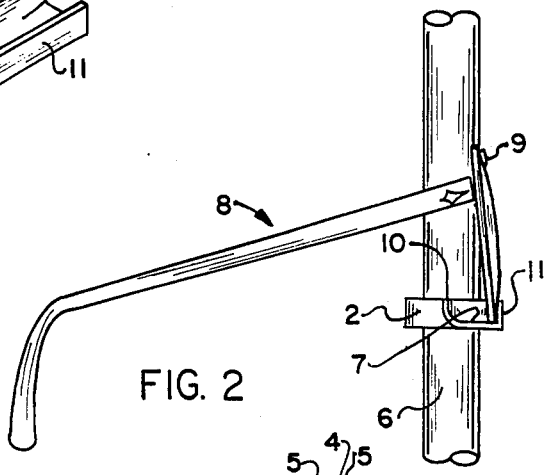
FIG. 2 is a side elevational view of the tray of FIG. 1 clipped onto a supporting post and holding a pair of eyeglasses.

FIG. 2 shows trays 1 positioned on post 6 and eyeglasses 8 resting on the front edges 7′ of troughs 7 with it bridge 9 resting against post 6. Because of the spacing between trough front edges 7′ and post 6, the glasses are tilted backward.

Figure 3:
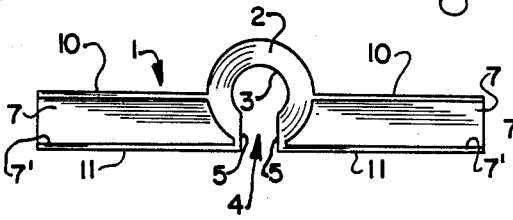
FIG. 3 is a top view of the tray of FIG. 1.
Figure 4:
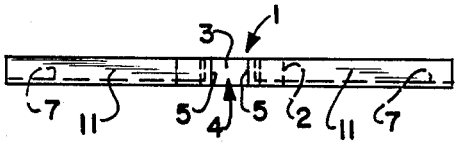
FIG. 4 is a front elevational view of the tray of FIG. 1.
Figure 5:
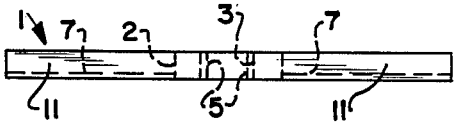
FIG. 5 is a side elevational view of the tray of FIG. 1.

FIGS. 3, 4 and 5 show post-encircling portion 2 with circular opening 3 joining with entry opening 4 defined by walls 5. Troughs 7 have back walls 10 and front walls 11. In these views the entry opening 4 is at the front of the tray so that the tray is clipped onto the supporting post from the rear of the post which is preferred arrangements.

Figure 6:
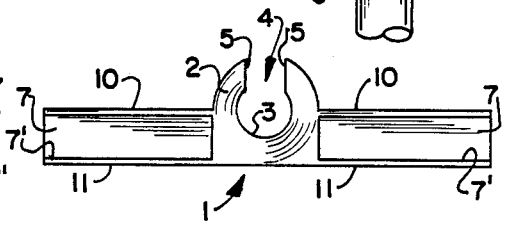
FIGS. 6, 7 and 8 are views of another modification of the tray corresponding to views of FIGS. 3, 4 and 5 except that the entry opening is at the back instead of the preferred entry opening at the front of the tray.
Figure 7:
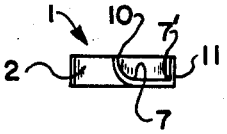
Figure 8:
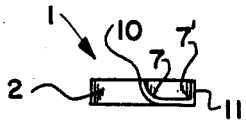

FIGS. 6, 7 and 8 show another modification of the invention in which the entry opening 4 is at the rear of the tray so that the tray is clipped onto the supporting post from the front of the post.

The supporting post or posts are preferably made of clear or transparent plastic but may be made of other materials including translucent or colored plastic, wood, metal, etc. In some cases wood or metal posts may be coated with paint, metal foil, etc., provided that sufficient tolerance is used to accommodate the additional thickness of the coating or foil to give the desired thickness of the post for positioning the tray thereon.

Figure 9:
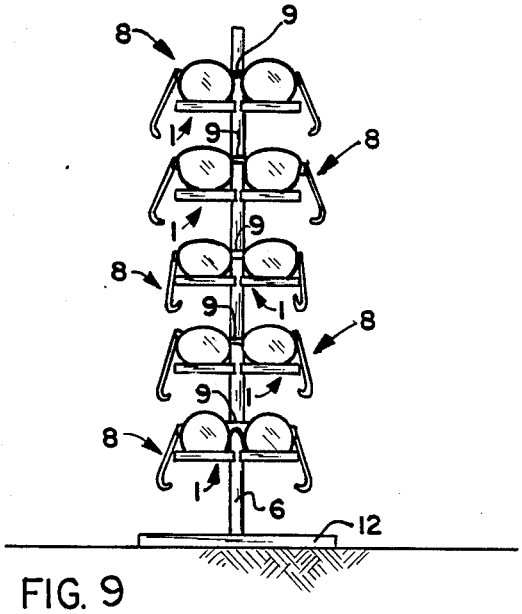
FIG. 9 is a front elevational view of a post supporting a number of the trays of FIG. 1 and displaying on each tray a pair of eyeglasses.

FIG. 9 shows five trays 1 of the type shown in FIGS. 1–5 clipped onto post 6, mounted on base 12, and five pairs of glasses 8.

In addition to the uses shown above for displaying eyeglasses, these trays may be used for displaying various other items. Small items such as rings may be laid in the troughs of the trays. Larger items such as bracelets, necklaces, etc., may be hung or draped over the outer walls of the troughs.

While wall 10 has been shown as two individual walls which will be positioned on both sides of the post 6, it is also contemplated that in the case where the entry opening is in the back of the tray, these walls may comprise one continuous wall reaching across in front of post 6. It is only necessary that the appropriate distance of the front of the trough from the post is maintained as described above. In such cases part of the trough may also extend across in front of the post.

While the distance of the above-described plane from the closest point of the post has been indicated as advantageously 0.1–0.3 inch preferably 0.15–0.25; inch, it is contemplated that this distance may be even larger, namely up to 0.5 inch or even larger especially where the frame around the lenses or the bridge is especially thick, or where it is desired to have the eyeglasses lean backward at a greater angle.

Figure 10:
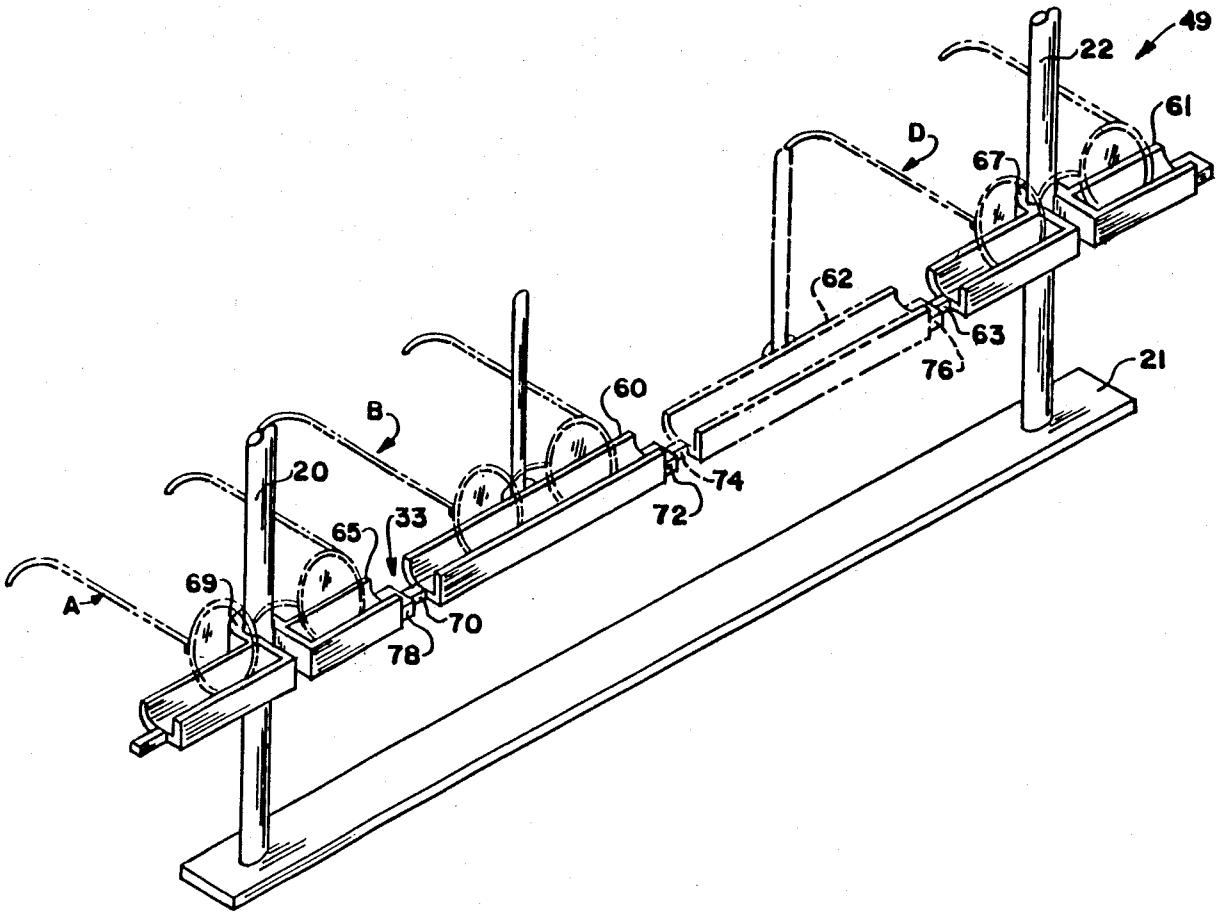
FIG. 10 is an isometric view of the article display of the invention.

FIG. 10 is an isometric view of the article display of the invention. FIG. 10 illustrates a plurality of display trays 49 spanning the distance between first post 20 and second post 22. The display trays include horizontal member 61 releasably secured to second post 22 by grasping means 67 with the tenon 63 of horizontal member 61 releasably secured within the mortise 76 of second bridging display tray 62. The second bridging display tray 62 is shown in phantom to illustrate its removal from the article display upon the sale of the eyeglasses once positioned thereon for display. With the removal of tray 62, the article display is completely filled with articles on display. The tenon 74 of the second bridging display tray 62 is received by mortise 72 of the first bridging display tray 60 and the tenon 70 of the first bridging display tray 60 is releasably secured within the mortise 78 of horizontal member 65. The mating of tenon 70, 74 and 63 within mortise 78, 72 and 76, respectively, forms a mortise and tenon joint generally designated 33. Horizontal member 65 is releasingly gripped to supporting post 20 by grasping means 69. Positioned within horizontal member 61, horizontal member 65, and first bridging display tray 60 are eyeglasses A, D and B, respectively.

Figure 11:
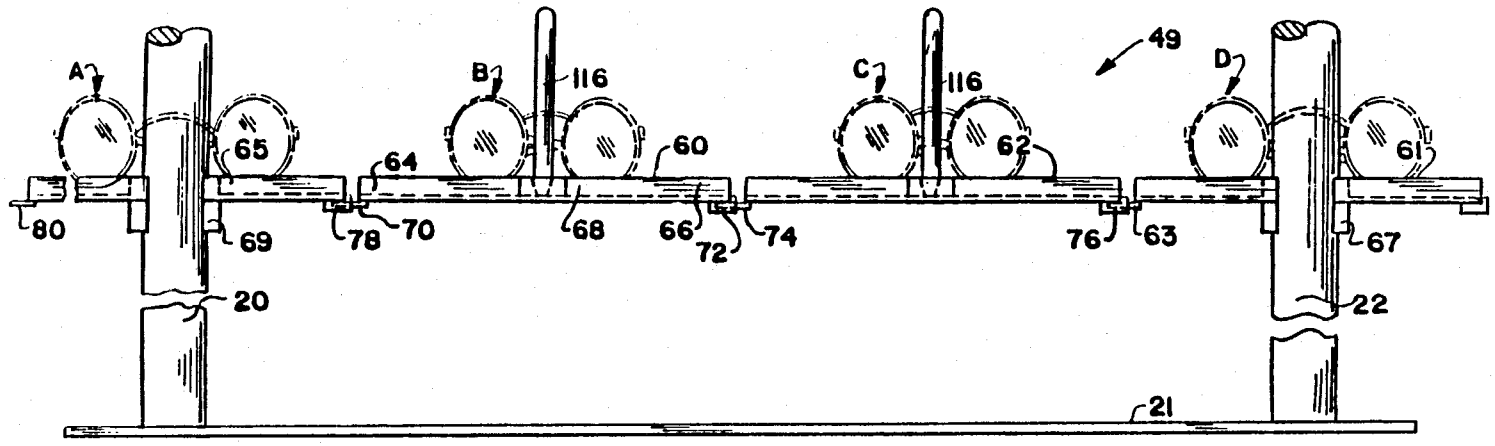
FIG. 11 is a front view of the embodiment of an article display of the invention illustrated at FIG. 10.

FIG. 11 is a front view of the embodiment of an article display of the invention illustrated at FIG. 10. FIG. 11 illustrates a plurality of display trays 49 spanning the distance between first post 20 and second post 22. The display trays include horizontal member 61 releasably secured to second post 22 by grasping means 67 with the tenon 63 of horizontal member 61 releasably secured within the mortise 76 of second bridging display tray 62. The second bridging display tray 62 is included in FIG. 11 to illustrate complete spanning or bridging of the distance between supporting posts 20 and 22 by the plurality of display trays 51 prior to the sale of eyeglasses "C" from tray 62. The tenon 74 of the second bridging display tray 62 is received by mortise 72 of the first bridging display tray 60 and the tenon 70 of the first bridging display tray 60 is releasably secured within the mortise 78 of horizontal member 65. Horizontal member 65 is releasingly gripped to supporting post 20 by grasping means 69.

Figure 12:
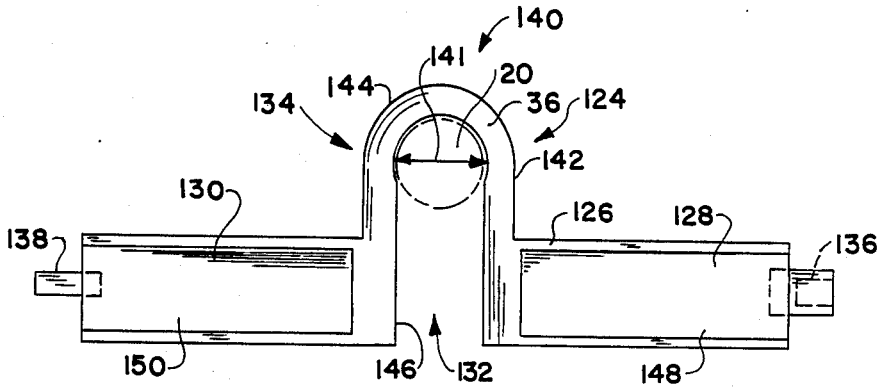
FIG. 12 is a top view of a horizontal member illustrating a mortise and tenon.

FIG. 12 is a top view of horizontal member generally designated 124. The description of horizontal member 126 describes other horizontal members such as horizontal members 24, 26, 61 and 65. FIG. 12 illustrates the first end 128 of horizontal member 126 having a mortise 136 and a tendon 138 located at second end 130. The intermediate portion 132 of horizontal member 126 defines a grasping means 134. The description of grasping means 134 of horizontal member 126 describes other grasping means such as grasping means 36, 46. Grasping means 134 comprises a semi-circle portion 140 having two sidewalls 142 and 144 extending from the semi-circle portion 140 to define an opening 146. First trough 148 and second trough 150 are axially spaced apart to permit the semi-circle portion 40 to grippingly receive the supporting posts 20 illustrated in phantom lines, such that the first 148 and second 150 troughs of horizontal member 126 are positioned substantially entirely in front of the vertical supporting post 20 shown in phantom lines.

Figure 13:
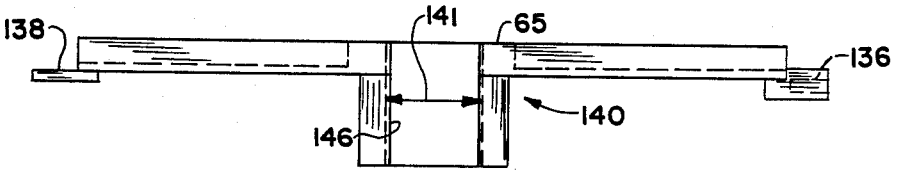
FIG. 13 is a front view of FIG. 12.

FIG. 13 illustrates a front view of the horizontal member 126 of FIG. 12. The inner diameter 141 of the semi-circle portion 140 corresponds to the outer diameter 141 of supporting post 20. Whereas, the distance between sidewalls 142 and 144 is slightly less than the inner diameter of semicircle portion 140 to enable the horizontal member to grip the supporting post in a stationary manner.

Figure 14:
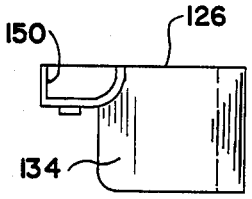
FIG. 14 is a side view of FIG. 13.

FIG. 14 is a left side view of the invention illustrated at FIG. 13 illustrating second trough 150 and tenon 138.

Figure 15:
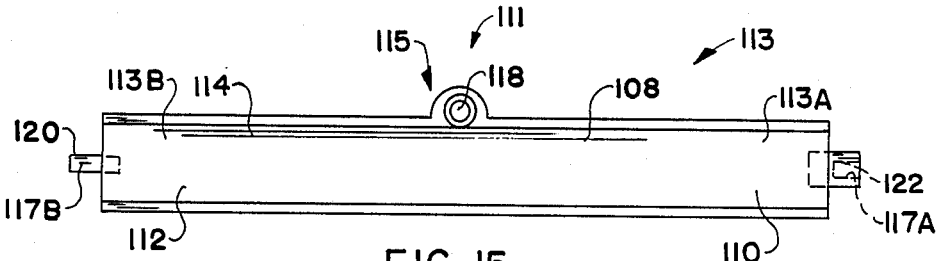
FIG. 15 is a top view of a bridging display tray of the invention.

FIG. 15 is a top view of a bridging member generally designated 111. The article displaying member 113 includes a first 113*a* and second 113*b* segments having a mortise 117*a* and tenon 117*b*, respectively, such that a mortise and tenon joint is formed as illustrated at FIG. 10. A more specific article displaying member is bridging display tray 108. The bridging tray 108 includes a first end 110 and a second end 112 with a trough 114 extending therebetween. The bridging tray 108 further includes an intermediate portion 115 positioned between the first end 110 and second end 112. An aperture 118 is formed at the intermediate portion 115 of bridging member 108. An elongated bar 116, not shown, having a first end 117 and a second end 119 with the first end 117 being slidably received into aperture 118. The positioning of the elongated bar 116 into aperture 118 enables the article, such as eyeglasses, to be positioned within trough 114 at an angle to permit enhanced display and compete visual examination. Located at the first end 110 of bridging tray 108 is mortise 122. In a like manner located at the second end 112 of bridging tray 108 is located tenon 120. Mortise 122 and tenon 120 cooperate with their mating counterparts in adjacent display trays such as horizontal member 65 and bridging display tray 60 to enable the structural spanning by the bridging trays of the space separating first post 20 and second post 22 as illustrated at FIG. 10.

Figure 16:
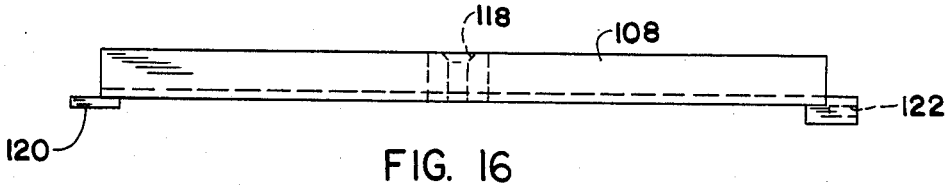
FIG. 16 is a front view of FIG. 15.

FIG. 16 is a front view of FIG. 15 which illustrates aperture 118 into which is received elongated bar 116, not shown. Also illustrated are tenon 120 and mortise 122 for interattaching trays having the mating counterparts to form a mortise and tenon joints as illustrated at FIG. 10.

Figure 17:
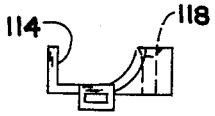
FIG. 17 is a side view of FIG. 16.

FIG. 17 is a side view of FIG. 16 which illustrates trough 114 which receives the article to be displayed and aperture 118 which receives elongated bar 116, not shown. Trough 114 and elongated bar 116 cooperate to position a pair of eyeglasses thereon.

Figure 18:
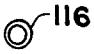
FIG. 18 is a front view of elongate rod for use with the bridging display tray of FIG. 15.
Figure 19:
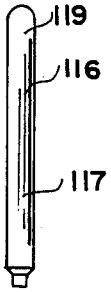
FIGS. 19 and 20 are a top and bottom view of FIG. 19, respectively.
Figure 20:
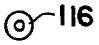

FIGS. 18, 19 and 20 illustrate elongated bar 116 with a top view of the elongated bar 116 illustrated at FIG. 18 and a bottom view of elongate bar 116 illustrated at FIG. 20 and a front view of elongate bar 116 illustrated at FIG. 19. Elongate bar includes a first end 117 and a second end 119 with the first end 117 being slidably received into aperture 118. When positioned into aperture 118, elongate bar functions as a "nose" to hold the eyeglasses in a position like that if positioned on a face of a glasses wearer.

Figure 21:
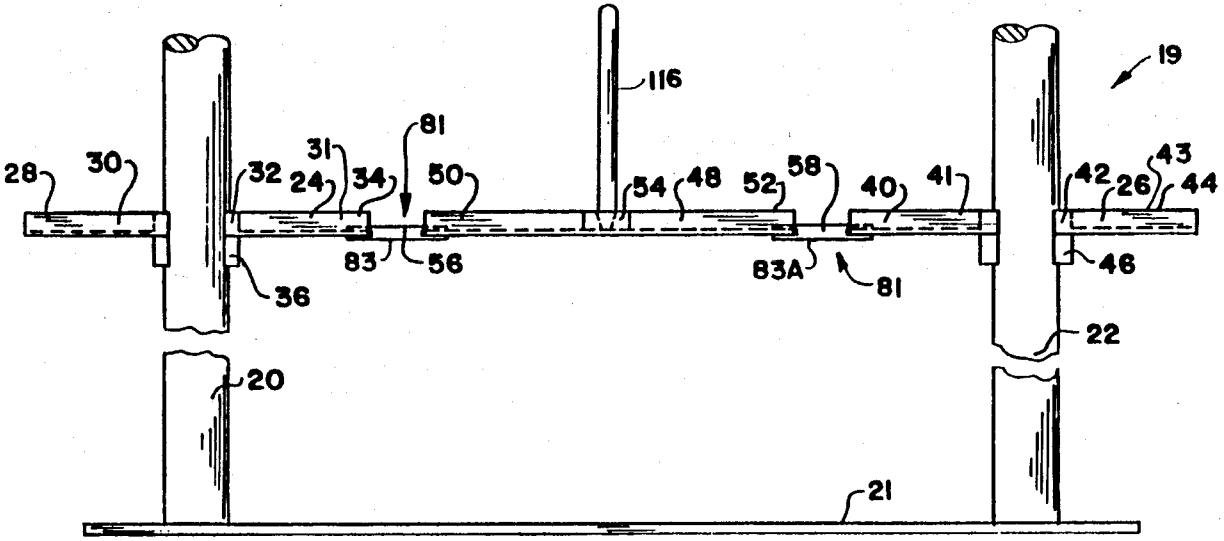
FIG. 21 is a front elevational view of an article display of the invention for displaying a plurality of articles.

FIG. 21 illustrates another embodiment of the article display of the invention 19 for displaying a plurality of articles thereon. In this embodiment, first post 20 and second supporting post 22 are secured to a base 21. First horizontal member 24 is releasably attached to first post 20 by grasping means 36. In a like manner, second horizontal member 26 is releasably attached to second post 22 by grasping means 46. The first horizontal member 24 includes a first portion 28, a second portion 34 and an intermediate portion 32. The first portion 28 defines a first trough 30 and the second portion 34 defines a second trough 31. In like manner, the second horizontal member 26 includes a first portion 40, a second portion 44 and an intermediate portion 42. The first portion 40 defines a first trough 41 and the second portion 44 defines a second trough 43. The first 30 and 41 troughs and second 31 and 43 troughs of the first 24 and second 26 horizontal members cooperate with first 20 and the second 22 post to position the eyeglasses (not shown) on the first 24 and second 26 horizontal members. Positioned between the first post 20 and second post 22 is bridging member 48. Bridging member 48, described in greater detail above, includes a first end section 50, a second end section 52 and a mid section 54. A first fastening means 56 releasably interconnects the first end section 50 of bridging member 48 to the second portion 34 of the first horizontal member 24. In a like manner, second fastening means 58 releasably interconnects the second end second 52 of bridging member 48 to the first portion 40 of the second horizontal member 26. First fastening means, generally designated as 56 and second fastening means, generally designated as 58 interconnect the first and second horizontal members 24 and 26 to the bridging member 48. More specifically, the fastening means include interlinking rod generally designated 81, described in detail below. As illustrated, interlinking rod 83 and 85 interconnect the displaying trays to span the distance between supporting posts 20 and 22. The fastening means further includes the tenon and mortice joint.

The intermediate portion 42 of bridging member 48 further includes an elongate bar 116 which cooperates with the trough 47 of bridging member 48 to position the eyeglasses (not shown) on the bridging member 48. The article display of the invention permits an article to be displayed, such as eyeglasses, at each horizontal member 24 and 26 and at the bridging member 48. This enables a article displaying member or display tray to be removed from the article display when the article, such as eyeglasses, are removed from the article display there maintaining the article display in a filled condition. Likewise, this enables the addition of one or more article display members or trays as one or more articles to be displayed become available thereby providing an additional display tray in a previously filled article display.

Figure 22:
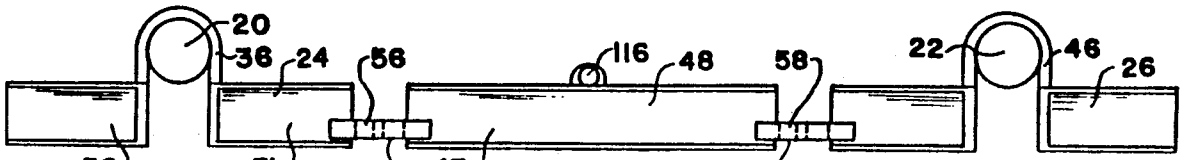
FIG. 22 is a top view of FIG. 21.

FIG. 22 is a top view of FIG. 21 absent base 21. FIG. 22 illustrates first horizontal member 24, bridging member 48 and second horizontal member 26 spanning the distance between first post 20 and first post 22 as enabled by interlinking rods 83 and 83*a*.

Figure 25:
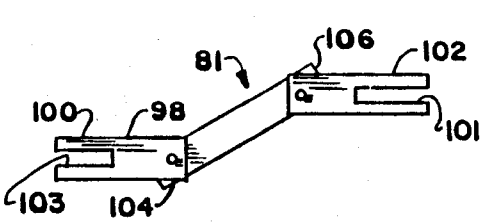
FIG. 25 is a front view of a hinged interlinking rod.
Figure 24:
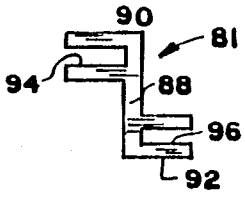
FIG. 24 is a front view of another embodiment of the interlinking rod.
Figure 23:
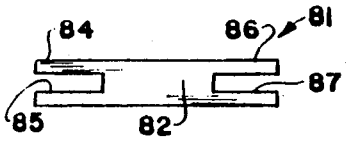
FIGS. 23 is a front view of an embodiment of an interlinking rod illustrated in use in FIG. 12.

FIGS. 23, 24 and 25 illustrate different embodiments of the interlinking rod generally designated 81. Interlinking rod 81 is used to interconnect display trays which do not have integrally formed connecting means such as those of bridging display tray 62 at FIG. 11, for example. However, interlinking rod 81 may be used with trays with integrally formed connecting means, if desired. FIG. 13 illustrates a first embodiment of the interlinking rod 82. Interlinking rod 82 includes a first end 84 and a second end 86. An opening 85 is formed in the first end 84 of interlinking rod 82 to releasably receives an end portion of a horizontal member to interconnect a first end section of a bridging member 48 to an end portion of a horizontal member or to an end section of a bridging member. FIG. 21 illustrates interlinking rod 82 interconnecting horizontal members 24 and 26 with bridging member 48.

FIG. 24 illustrates an off-set embodiment 88 of interlinking rod 81. The off-set interlinking rod 88 includes first end 90 and a second end 92. An opening 94 is formed at the first end 90 of the off-set interlinking rod 88. In a like manner, an opening 96 is formed at the second end 92 of off-set interlinking rod 88. Openings 94 and 96 releasably secure one article display tray a portion of which is received in opening 94 to an adjacent article display tray a portion of which is received in opening 96.

FIG. 25 illustrates a third embodiment 98 of interlinking rod 81. Hinged interlinking rod 98 includes a first end 100 and a second end 102. A first hinge 104 is positioned proximate the first end 100 of the hinged interlinking rod 98. A second hinge 106 is positioned proximate the second end 102 of hinged interlinking rod 98. Rotation about hinges 104 and 106 is reduced in order to enable the positioning of a article display tray received in opening 103 to retain its position relative the article display tray received within opening 101 notwithstanding the weight of the article displayed.

Figure 26:
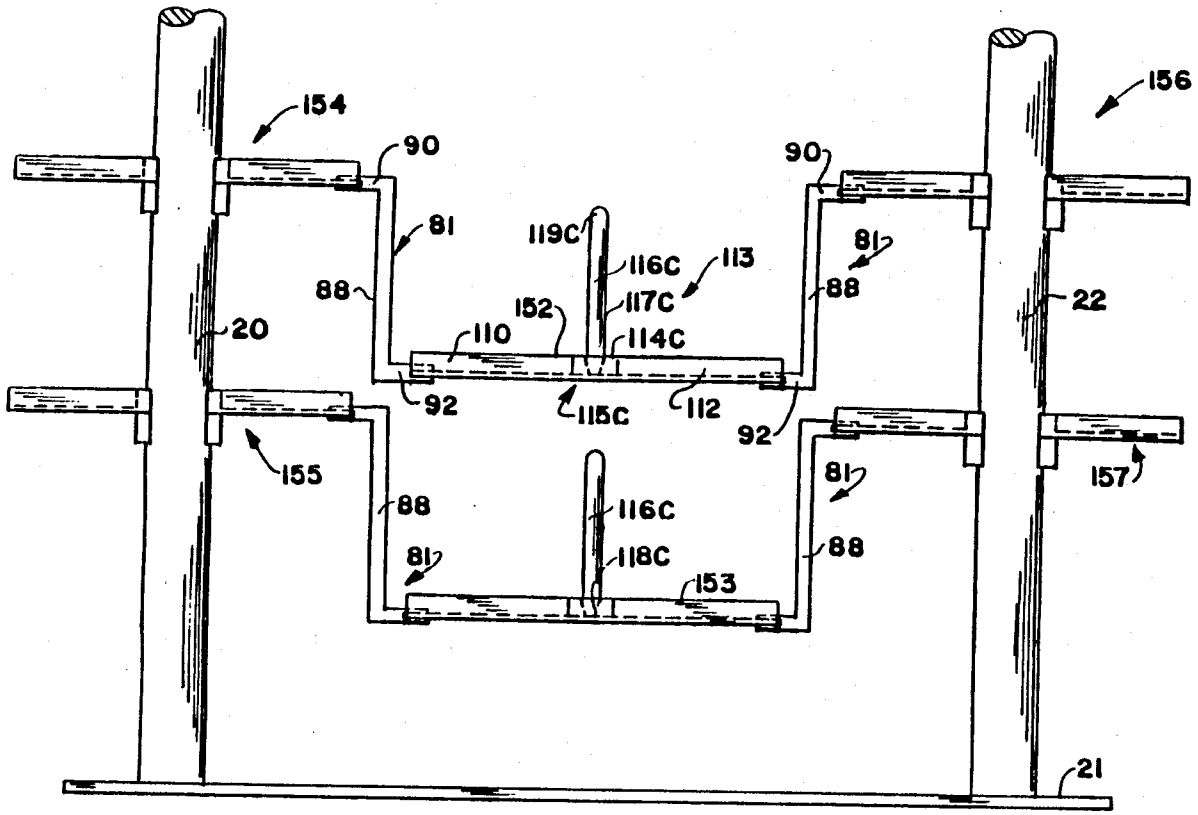
FIG. 26 is a front view of another embodiment of the article display of the invention.

FIG. 26 is a front view of another embodiment of the article display of the invention. FIG. 26 illustrates the use of off-set interlinking rod 88 to enable the spanning of a first post 20 and a second post 22 by article display trays which do not have integrally formed connecting means. Article display member 113 is described by bridging tray 108 at FIG. 15 except that bridging tray 152 does not include mortise 122 and tenon 120 of bridging tray 108. The bridging trays 152 and 153 each include a first end 110C and a second end 112C with a trough 114C extending therebetween.

The bridging trays 152 and 153 further include an intermediate portion 115C positioned between the first end 110C and second end 112C. An aperture 118C is formed at the intermediate portion 115C of each bridging member 152 and 153. An elongated bar 116C having a first end 117C and a second end 119C with the first end 117C being slidably received into aperture 118C. The positioning of the elongated bar 116C into aperture 118C enables the article, such as eyeglasses, to be positioned within trough 114C at an angle to permit enhanced display and compete visual examination. The spanning of the distance between supporting posts 20 and 22 depends on interlinking rod 88 to interconnect the bridging tray 152 with horizontal members 154 and 156. In like manner, the spanning of the distance of the distance between supporting posts 20 and 22 by horizontal member 155, bridging tray 153 and horizontal member 157 depends on interlinking rod 88 to enable interconnection therebetween.

The opening, such as 85, 87, 94 and 96 of interlinking rod 81 which grasp the display inserted therein permit pivoting of the grasped display tray in a substantially horizontal plane. This enables, for example, a circular article display comprising for example four supporting posts and a sufficient number of horizontal members and bridging members to support and close the circle. Opening 101 and 103 permit even greater pivoting of the display tray.

The bridging member, article display member or display tray is composed of a resilient plastic material. Preferably, the plastic material is a polycarbonate resin. Most preferably the resin is transparent.

Preferably, the article display member is such that the trough is open at the ends farthest from the supporting post.

The grasping means of the article display member is such that the entry portion of the opening for receiving the supporting post is positioned on the same side or the opposite side of the tray as the first linear edge. Preferably, the grasping means of the article display member is such that the entry portion of the opening for receiving the supporting post is positioned on the same side of the tray as the first linear edge.

While certain features of this invention have been described in detail with respect to various embodiments thereof, it will of course be apparent that other modifications can be made within the spirit and scope of this invention, and it is not intended to limit the invention to the exact details insofar as they are defined in the following claims.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An article display for displaying a plurality of articles comprising:

a base;

a plurality of supporting posts attached to said base with each supporting post extending vertically relative said base and being spaced apart relative each other;

a plurality of horizontal members with each horizontal member of said plurality of horizontal members including a first portion, a second portion and an intermediate portion;

each of said first and second portions of each said horizontal member defining a first and a second trough, respectively, to enable the positioning of the article to be displayed thereon;

each said intermediate portion of each said horizontal member defining a grasping means for releasingly gripping one of said plurality of vertical supporting posts to enable each said horizontal member to be positioned along said vertical length of one of said plurality of supporting posts;

each said first and second portions of each said horizontal member being axially spaced apart to provide an opening to permit each said grasping means of each said horizontal member to grippingly receive one of said plurality of supporting posts;

a bridging member for interconnecting one of said horizontal members positioned at one of said supporting posts of said plurality of supporting posts with another said horizontal member of said plurality of horizontal members positioned at an adjacent supporting post of said plurality of supporting posts;

said bridging member having a first section, a second section and a midsection;

a first fastening means for enabling a releasable attachment of said first section of said bridging member with one horizontal member of said plurality of horizontal members positioned along said length of one of said supporting posts; and a second fastening means for enabling a releasable attachment of said second section of said bridging member with another horizontal member of said plurlity of horizontal members positioned along said length of said adjacent supporting post of said plurality of supporting posts thereby providing a continuous display for the plurality of articles to be displayed spanning from one of said plurality supporting posts to said adjacent supporting post and enabling the removal of one of said horizontal members and bridging members as determined by the removal of displayed articles from article display thereby maintaining an article display filled with displayed articles.

2. An article display for displaying a plurality of articles comprising:

a base;

a first and a second supporting post attached to said base with each said post extending vertically relative said base and being spaced apart relative each other;

a first and a second horizontal member;

each said first and second horizontal members including a first portion, a second portion and an intermediate portion;

each of said first and second portions of each said first and second horizontal members defines a first and a second trough, respectively, to enable the positioning of the article to be displayed thereon;

each said intermediate portion of each said first and second horizontal members defines a grasping means for releasingly gripping one of said first and second vertical supporting posts to enable each of said first and second horizontal members to be positioned along said vertical length of said first and second supporting posts;

each said first and second troughs of each of said first and second horizontal members include a first and a second end such that each said first end of each said first and second troughs is distally positioned relative said intermediate portion of each first and second horizontal members;

a bridging member;

said bridging member having a first section, a second section and a midsection;

a first fastening means for enabling an interconnecting attachment of said bridging member with said first horizontal member when said first horizontal member is positioned along said length of said first supporting post by fastening said first end of said first horizontal member to said second section of said bridging member; and a second fastening means for enabling interconnecting attachment of said bridging member with said second horizontal member when said second horizontal member is positioned along said length of said second supporting post by fastening said first end of said second horizontal member to said first section of said bridging member thereby providing a continuous display for the plurality of articles to be displayed spaning from said first supporting post, along said bridging member and to said second supporting post and enabling the removal of one of said first and second horizontal member and bridging member as determined by the removal of displayed articles from article display thereby maintaining an article display filled with displayed articles.

3. The article display of claim 2 wherein said bridging member includes a plurality of article displaying members where each article displaying member of said plurality of article displaying members displays one of the plurality of articles thereon; and each said article displaying member of said plurality of article displaying members having a first end segment, a second end segment and a mid-segment such that said first end segment and said second end segment have an interattaching means for enabling one article displaying member of said plurality of article displaying member to releasably attach and interconnect to another one article displaying members of said plurality of article displaying members thereby enabling the removal of one of said article display members as one of the articles displayed from the plurality of articles displayed is removed to enable the article display to remain filled with displayed articles.

4. The display of claim 3 wherein said interattaching means is a mortise and tenon joint such that said tenon positioned at one of said first and second end segments of said article displaying member of said plurality of article displaying members is slidably and frictionally received into a mortise formed at one of said first and second end segment of another one of said article displaying member of said plurality of article displaying members to releasingly attach and interconnect said article displaying members at said mortise and tenon joint.

5. The article display of claim 3 wherein said plurality of article displaying members includes a plurality of bridging display trays wherein each said bridging display tray includes a first end and a second end with a trough extending therebetween to enable the positioning of the article to be displayed thereon;

an intermediate section positioned between said first and said second end of said bridging display tray;

said intermediate section of said bridging display tray includes an aperture formed therein;

an elongated bar having a first and a second end; and said first end of said elongated bar being securably received into said opening formed in said bridging display tray to enable the article to be displayed to be supported in an upright manner thereby enhancing the appearance of the article displayed and presenting the article displayed in a manner to permit visual examination.

6. The article display of claim 2 wherein said grasping means comprises a semicircle portion having two sidewalls leading from said semicircle portion thereby defining said opening formed by said axially spaced apart said first and second portions of each said horizontal member to permit said semicircle portion to grippingly receive said supporting post such that said first and said second troughs of each said horizontal member are positioned substantially entirely in front of the vertical supporting post.

7. The article display of claim 2 wherein each said first and second portions of each said first and second horizontal members is axially spaced apart to provide an opening to permit each said grasping means of each said first and second horizontal member to grippingly receive one of said first and second supporting posts.

8. An article display for displaying a plurality of articles comprising:

a base;

a first and a second supporting post attached to said base with each said supporting post extending vertically relative said base and each said supporting post being spaced apart relative each other;

a first and a second horizontal member;

each said first and second horizontal members includes a first portion, a second portion and an intermediate portion;

each of said first and second portions of each said first and second horizontal member defines a first and a second trough, respectively, to enable the positioning of the article to be displayed thereon;

each said intermediate portion of each said first and second horizontal members defines a grasping means for releasingly gripping one of said first and second vertical supporting posts to enable each said first and second horizontal members to be positioned along said vertical length of said first and second supporting posts;

each said first and second portions of each said first and second horizontal members being axially spaced apart to provide an opening to permit each said grasping means of each said first and second horizontal members to grippingly receive one of said first and second supporting posts;

each said first and second troughs of each said first and second horizontal members includes a first and a second end such that each said first end of each said first and second troughs is distally positioned relative said intermediate portion of each first and second horizontal member;

a bridging member for interconnecting said first horizontal member positioned at said first supporting post with said second horizontal member positioned at said second supporting post;

said bridging member includes a plurality of article displaying members where each article displaying member of said plurality of article displaying members displays one of the plurality of articles thereon;

each said article displaying member of said plurality of article displaying members having a first end segment, a second end segment and a mid-segment;

said first end segment and said second end segment of each article displaying member includes an interattaching means for enabling one article displaying member of said plurality of article displaying members to releasably attach and interconnect to another one article displaying member of said plurality of article displaying members;

said interattaching means of each said article displaying member of said plurality of article displaying members is a mortise and tenon joint such that said tenon positioned at one of said first and second end segments of said article displaying member is slidably and frictionally received into a mortise formed at one of said first and second end segment of another one of said article displaying member to releasingly attach and interconnect said article displaying members at said mortise and tenon joint;

a first fastening means for enabling an interconnecting attachment of one of said article display members with said first horizontal member when said first horizontal member is positioned along said length of said first supporting post; and a second fastening means for enabling an interconnecting attachment of one of said plurality of article display members with said second horizontal member when said second horizontal member is positioned along said length of said second supporting post thereby providing a continuous display for the plurality of articles to be displayed spanning from said first supporting post to said second supporting post and enabling the removal of one of said first and second horizontal member and bridging member as determined by the removal of displayed articles from article display thereby maintaining an article display filled with displayed articles and enabling the addition of more article display members as more articles to be displayed become available for display thereby providing additional article display members in the filled article display.

9. The article display of claim 8 wherein said plurality of article displaying members includes a plurality of bridging display trays wherein each said bridging display tray includes a first end, a secod end with a trough extending therebetween to enable the positioning of the article to be displayed thereon;

an intermediate section positioned between said first end and said second end of said display tray;

said intermediate section of said bridging display tray includes an aperture formed therein;

an elongated bar having a first and a second end; and said first end of said elongated bar being securably fit into said opening formed in said bridging display tray to enable the article to be displayed to be supported in an upright manner thereby enhancing the appearance of the article displayed and presenting the article displayed in a manner to permit visual examination.

10. The article display of claim 8 wherein said grasping means comprises a semicircle portion having two sidewalls leading from said semicircle portion thereby defining said opening formed by said axially spaced apart said first and second portions of each said horizontal member to permit said semicircle portion to grippingly receive said supporting post such that said first and second troughs of each said horizontal member are positioned substantially entirely in front of the vertical supporting post.

11. An article display comprising:

a base;

a supporting post attached to said base and extending substantially vertically relative said base;

a first and a second article displaying member for displaying an article thereon respectively;

said first article displaying member being securably fastened to said supporting post in a substantially horizontal plane relative said supporting post;

an interlinking rod having a first and a second end;

an opening formed at each said first and second ends of said interlinking rod;

said opening at said first end of said rod being dimensioned to frictionally receive said first article displaying member to enable the attachment of said interlinking to said first article displaying member; and said opening at said second end of said interlinking rod being dimensioned to frictionally receive said second article displaying member thereby connecting said first article displaying member with said second article displaying member to enable the display of a plurality of articles where only said first article displaying member is directly fastened to said support post and to enable the removal of said second article displaying member as one of the articles displayed from one of said first and second article displaying members is removed thereby maintaining an article display filled with displayed articles.

12. The article display of claim 11 wherein said interlinking rod further includes an intermediate segment; and said intermediate segment of said interlinking rod includes a first hinge to enable movement of said first end of said rod relative said second end of said interlinking rod thereby enhancing visual examination of the article displayed by manipulation of said first hinge to present the article displayed at its best view.

13. The article display of claim 12 wherein said interlinking rod further includes a second hinge positioned at one of said first and second ends of said interlinking rod to enable said second article displaying member to be positioned at any desired display angle relative the display angle of said first article displaying member thereby further enhancing the appearance of the article displayed and further presenting the article displayed at its best view for visual examination.

14. An article display comprising:

a base;

a supporting post attached to said base and extending substantially vertically relative said base;

a first and a second article displaying member for displaying an article thereon respectively;

said first article displaying member being securely fastened to said supporting post in a substantially horizontal plane relative said supporting post;

an interlinking rod having a first and a second end; an opening formed at each said first and second ends of said interlinking rod;

said opening at said first end of said interlinking rod being dimensioned to frictionally receive said first article displaying member to enable the attachment of said interlinking rod to said first article displaying member;

said interlinking rod further includes an intermediate segment;

said intermediate segment of said interlinking rod includes a first hinge to enable movement of said first end of said interlinking rod relative said second end of said interlinking rod;

said interlinking rod further includes a second hinge positioned at one of said first and second ends of said interlinking rod to enable said second article displaying member to be positioned at any desired display angle relative the display angle of said first article displaying member thereby enhancing visual examination of the article displayed by manipulation of said first hinge and said second hinge to present the article displayed at its best view for visual examination; and said opening at said second end of said rod being dimensioned to frictionally receive said second article displaying member thereby connecting said first article displaying member with said second article displaying member to enable the display of a plurality of article article where only said first article displaying member is directly fastened to said supporting post and to enable the removal of said second article displaying member as one of the articles displayed from one of said first and second article displaying members is removed thereby maintaining an article display filled with displayed articles.

15. An article display tray comprising:

a bridging display tray;

said bridging display tray including a first end and a second end with a trough extending therebetween to enable in use the positioning of an article to be displayed thereon;

an intermediate section positioned between said first and second ends of said bridging display tray;

said intermediate section of said bridging display tray includes an aperture formed therein;

an elongated bar having a first a second end;

said first end of said elongated bar dimensioned to be releasably and securably received into said aperture formed in said bridging display tray such that said bridging display tray supports said elongated bar to enable in use said article to be displayed to be supported in an upright manner thereby enhancing the appearance of the article displayed and presenting the article displayed in a manner to permit visual examination; and a first and a second attachment means positioned at said first and second ends of said bridging display tray, respectively, to enable in use said first end of said bridging display tray to be releasably secured to a first horizontal display tray and to enable said second end of said bridging display tray to be releasably secured to a second horizontal display tray thereby interconnecting said first and said second horizontal display trays and to enable the removal of said bridging display tray as one of the articles displayed from one of said first and second horizontal trays and said bridging display tray is removed thereby maintaining an article display filled with displayed articles.

16. The article display tray of claim 15 wherein said elongated bar is fixedly secured into said aperture formed into said intermediate part of said bridging display tray.

* * * * *

UNITED STATES PATENT AND TRADEMARK OFFICE

CERTIFICATE OF CORRECTION

PATENT NO. : 4,787,520

DATED : November 29, 1988

INVENTOR(S) : Robert C. Pearson

It is certified that error appears in the above-identified patent and that said Letters Patent is hereby corrected as shown below:

In the Specification

Column 1, line 25, delete "must" and insert therefor --may--.

Column 2, line 60, delete "members" and insert therefor --member--.

Column 4, line 57, delete "displaying" and insert therefor --displayed--.

Column 4, line 64, after "portion" insert --to--.

Column 5, line 26, delete "locking" and insert therefor --linking--.

Column 5, line 31, after "embodiment" delete --of--.

Column 7, line 36, delete "trays" and insert therefor --tray--.

Column 9, line 7, delete "40" and insert therefor --140--.

In the Claims

Column 16, line 29, delete "secod" and insert therefor --second--.

Column 17, line 1, after "interlinking" insert --rod--.

Column 17, line 10, delete "support" and insert therefor --supporting--.

UNITED STATES PATENT AND TRADEMARK OFFICE

CERTIFICATE OF CORRECTION

PATENT NO. : 4,787,520

DATED : November 29, 1988

INVENTOR(S) : Robert C. Pearson

It is certified that error appears in the above-identified patent and that said Letters Patent is hereby corrected as shown below:

Column 18, line 31, after "first" insert --and--.

Signed and Sealed this

Thirteenth Day of June, 1989

*Attest:*

DONALD J. QUIGG

*Attesting Officer*

*Commissioner of Patents and Trademarks*